United States Patent [19]

Liebetrau et al.

[11] 4,030,609

[45] June 21, 1977

[54] STORAGE AND DISPLAY APPARATUS EMPLOYING CANTILEVERED ROLLER TRACK

[75] Inventors: Richard E. Liebetrau, Cadillac; Larry J. Miller, Reed City, both of Mich.

[73] Assignee: Swiss Aluminium Ltd., Chippis, Switzerland

[22] Filed: Apr. 1, 1976

[21] Appl. No.: 672,665

[52] U.S. Cl. ..... 211/162; 308/3.8; 312/340

[51] Int. Cl.[2] ..... A47F 5/00

[58] Field of Search ..... 211/162, 46, 94, 94.5; 312/334, 335, 338, 340, 342, 345, 321, 341; 308/3 R, 3.5, 3.8; 16/91, 97, 106; 108/143

[56] References Cited

UNITED STATES PATENTS

| | | | |
|---|---|---|---|
| 769,024 | 8/1904 | Ryan | 312/342 |
| 962,837 | 6/1910 | Himmel | 312/340 |
| 1,702,789 | 2/1929 | Memmler | 211/162 |
| 2,098,828 | 11/1937 | Ludwick | 211/162 X |
| 3,732,633 | 5/1973 | Margolis et al. | 211/162 X |
| 3,912,086 | 10/1975 | deBruyn | 211/162 |

FOREIGN PATENTS OR APPLICATIONS

| | | | |
|---|---|---|---|
| 1,127,644 | 12/1956 | France | 308/3.8 |
| 471,130 | 10/1914 | France | 312/340 |

*Primary Examiner*—Roy D. Frazier
*Assistant Examiner*—Terrell P. Lewis
*Attorney, Agent, or Firm*—Robert H. Bachman; Robert A. Dawson

[57] ABSTRACT

A longitudinally reciprocable roller carrier useful in both a horizontal and a vertical track to support various live and dead loads which comprises a pair of juxtaposed track members of generally H-shaped cross section, a connecting track of generally I-shaped cross section located therebetween, and roller motive means connected to said connecting track and one of said track members facilitating the rollable reciprocation of said track members with respect to each other. The roller motive means comprises a plurality of strategically placed paired rollers located within the substantially enclosed track sections of the first and second track members which permit the carrier to support a continuously moving load in a cantilevered configuration.

13 Claims, 6 Drawing Figures

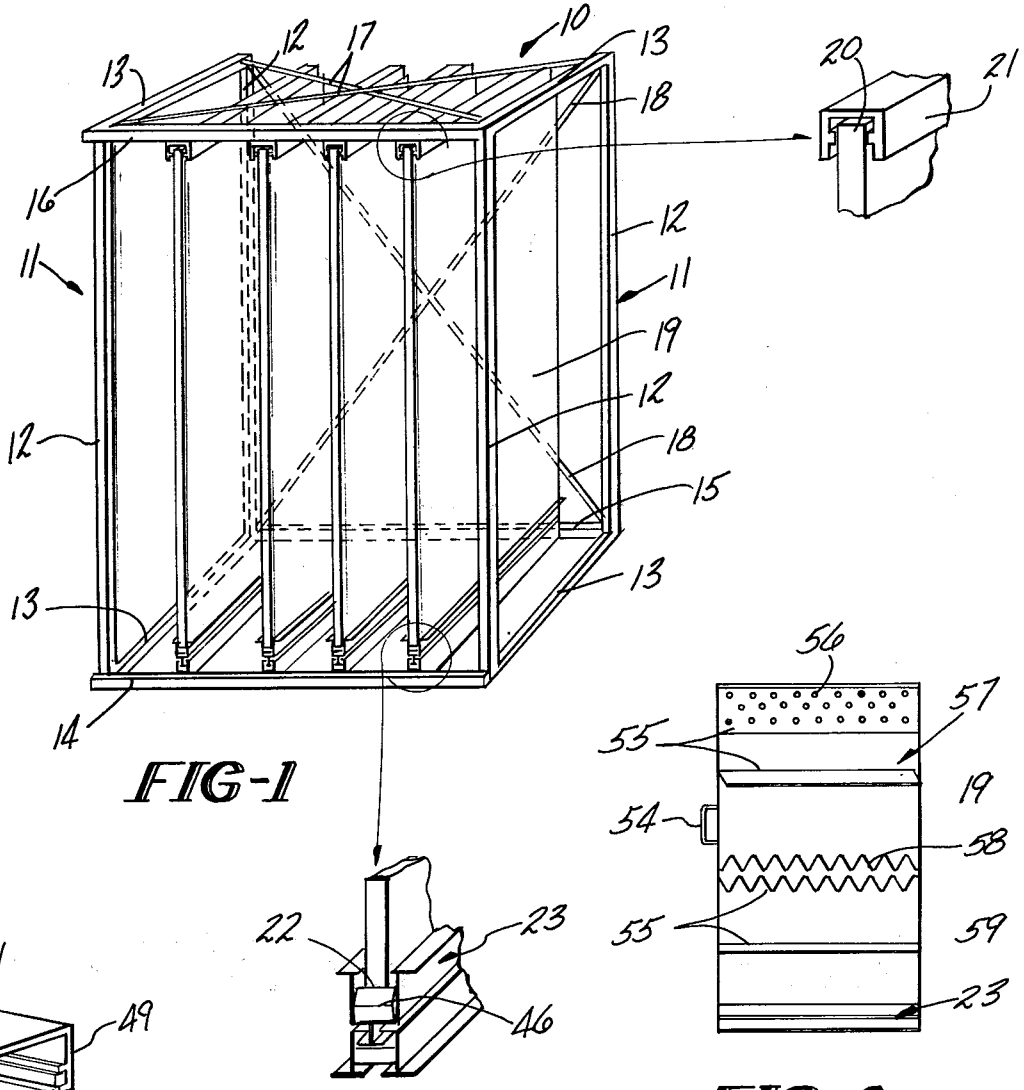
FIG-1
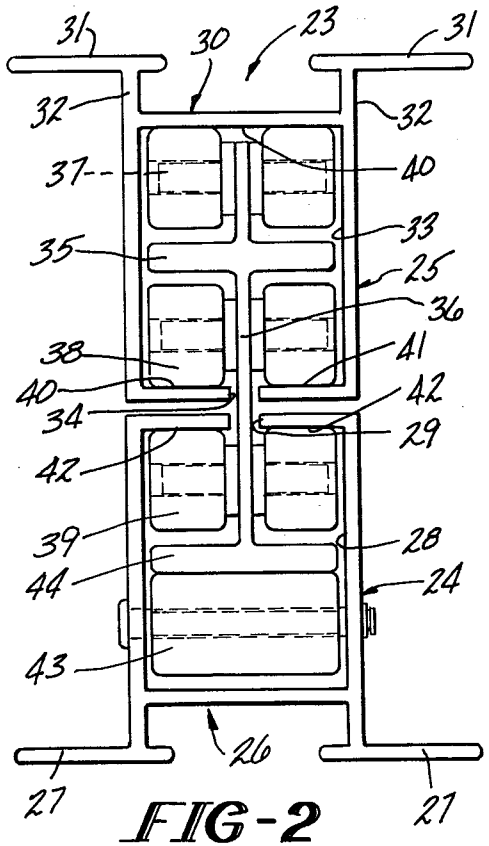
FIG-2
FIG-6
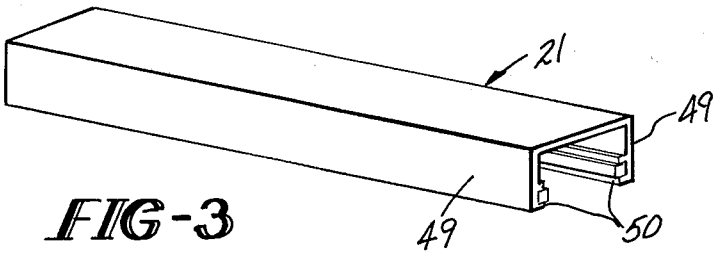
FIG-3

STORAGE AND DISPLAY APPARATUS EMPLOYING CANTILEVERED ROLLER TRACK

BACKGROUND OF THE INVENTION

The present invention relates to a roller carrier adapted for the support of movable live and dead loads. The invention is particularly suited to the provision of a carrier useful in conjunction with a storage or display apparatus employed in the retailing of goods wherein display structures are provided which are vertically extended and horizontally reciprocable.

The concept of providing roller carriers capable of supporting various loads particularly through horizontal movement is well-known. A wide variation in the structure and application for such roller carriers has developed to suit the large number of end uses to which some structures have been applied. Thus, roller carriers have been employed in such dissimilar areas as overhead suspension systems employed in industry and roller tracks employed in desk drawers and the like. Recently, a further adaptation of the roller carrier has developed which has particular value in the display and merchandising of goods in retail establishments. Specifically, a storage and display apparatus has been developed which comprises a series of parallel, planar vertically extending display members or supports, each individually adapted for horizontal reciprocation in and out of a generally rectangular framework or enclosure whereby goods displayed thereon may be scrutinized apart from other goods displayed on like parallel members. This particular concept is best illustrated in conjunction with a particular roller carrier in U.S. Pat. No. 3,912,086 to de Bruyn. The structure illustrated therein comprises a generally rectangular framework supporting a plurality of vertically extending channel members each supported on individual roller carriers for reciprocation into and out of the framework whereby access is gained to products displayed thereon. The roller carrier employed in de Bruyn employs a plurality of free rolling roller members located in four roller tracks arranged in parallel stacked relationship to each other.

Attempts to employ the de Bruyn roller track in connection with the disclosed display apparatus have resulted in numerous failures which were investigated and found to result from inherent design weaknesses. Specifically, the tracks appear to undergo excessive deflection under load with resultant binding and the like which prevented their extended use with loads of any appreciable amount. It was determined to be desirable to develop a roller carrier which would provide a constant balanced support under load in all positions of extension of the display member.

SUMMARY OF THE INVENTION

In accordance with the present invention, a roller carrier is disclosed which is useful in both the horizontal and vertical direction which comprises a generally rectangular, longitudinally extended first track member, said first track member possessing a generally H-shaped cross section which defines a support section and a track section, respectively. A second track member of substantially identical configuration and dimension to said first track member is also provided disposed adjacent and above said first member whereby respective track sections are in face-to-face juxtaposition. A longitudinally extending connecting track of identical length to said first and said second track members is located within and between said members. The connecting track possesses a generally I-shaped cross section and has attached thereto roller motive means comprising a plurality of paired rollers adapted to contact respective inner surfaces of the track sections of said track members in which said connecting track is located. The first track member is provided with a plurality of single rollers in the lowermost area of its track section which are adapted to rollably contact and support a corresponding surface of said connecting track.

The roller carrier of the present invention is provided with plate-like restrictor members located on said track members and said connecting track which limit the movement of the connecting track and the moving track member to a finite distance with respect to the stationary track member. The design of the roller carrier facilitates the support of various shaped loads, including box-like structures as well as planar structures. The movement of the roller carrier is achieved quite easily and without undue strain on the respective track members, with the result that the mechanism possesses a substantially increased useful life. Moreover, the design of the roller carrier vertually eliminates the aforenoted buckling under stress which characterizes the carriers of the prior art.

Accordingly, it is a principal object of the present invention to provide a roller carrier useful for the reciprocation of live and dead loads which possesses improved. strength and operation under stress.

It is a further object of the present invention to provide a roller carrier as aforesaid which is capable of installation and use in both the horizontal and the vertical plane.

It is a still further object of the present invention to provide a roller carrier as aforesaid which is easily manufactured and installed.

It is a still further object of the present invention to provide a roller carrier as aforesaid which is particularly useful in a vertical storage and display apparatus.

Other objects and advantages will become apparent from a consideration of the description which follows with reference to the accompanying drawings.

BRIEF DESCRIPTION OF THE DRAWINGS

FIG. 1 is a perspective view partly in phantom illustrating a vertically extended module employing the roller carrier of the present invention.

FIG. 2 is an end view of the roller carrier of the present invention exposed by the removal of the upper and lower closure members.

FIG. 3 is a perspective view of a guide channel useful in conjunction with the roller carrier of the present invention as illustrated in FIG. 1.

FIG. 6 is a schematic side view of a vertical panel similar to those employed in the module of FIG. 1.

DETAILED DESCRIPTION

Figure 4:
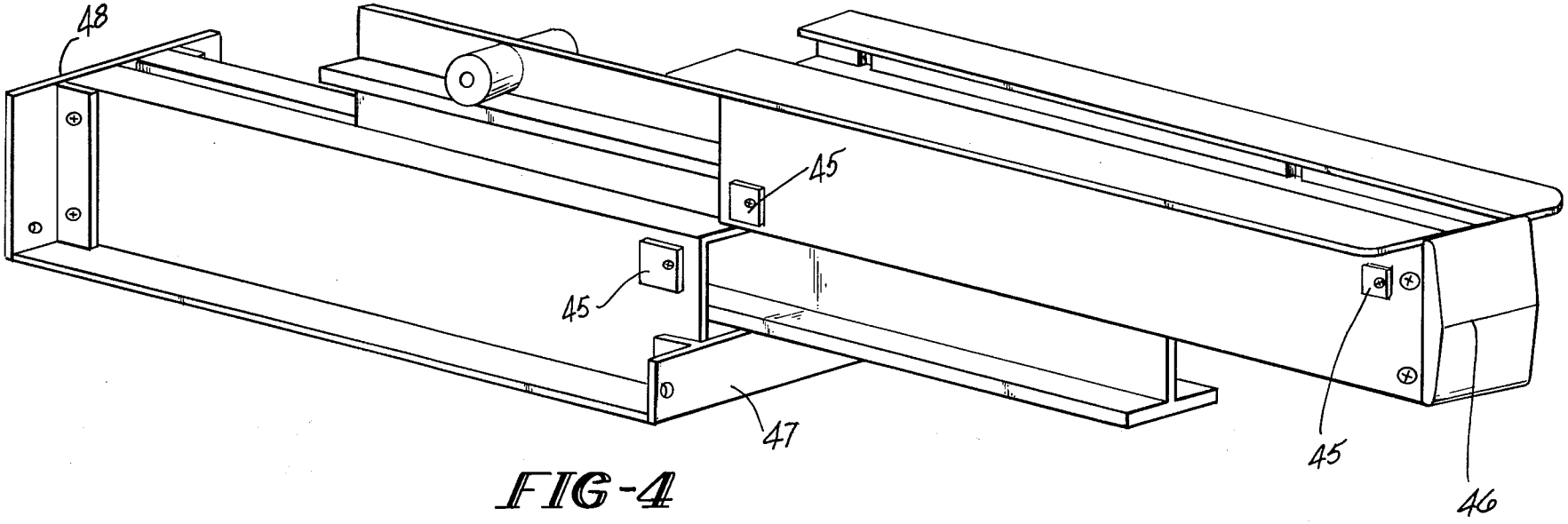
FIG. 4 is a perspective view of the roller carrier of the present invention in its fully extended position.

In accordance with the present invention, the foregoing objects and advantages are readily attained.

Referring now to the figures where like reference numerals designate like parts, FIG. 1 comprises a perspective view of a vertically extended display apparatus or module 10 employing the roller carrier of the present invention. It is to be understood that the following description is provided for purposes of illustration only and is not to be construed as limitative of the present invention, as the roller carrier may be employed in a wide variety of applications involving apparatus of widely divergent structure and function.

Module 10 is defined at its periphery by a pair of rectangular frames 11 comprising vertical members 12 and horizontal connecting members 13. The exact details of assembly and construction of frames 11 is not critical as it does not form a material part of the present invention.

Frames 11 comprise the end walls of module 10 and are connected at their lowermost ends by horizontal cross members 14 and 15, respectively. At the uppermost ends of frames 11, horizontal connector 16 is provided together with paired, diagonally extended struts 17. Struts 17 provide rigid support between the upper corners of frames 11. Similar such struts 18, shown partly in phantom, provide vertical support between frame members 11 and assist in absorbing the stresses exerted by the movement and loading of the display members 19, discussed in greater detail below.

A plurality of display members 19 are employed in module 10 illustrated in FIG. 1 which comprise, in the illustration, laterally flattened panels, racks, frames or the like, which are arranged in a laterally extended series in spaced parallel vertical relationship to each other. Each member 19, at its upper horizontal edge 20, is positioned within an upper guide channel 21, comprising a longitudinally extended structure possessing parallel walls projecting down into contact with horizontal edge 20. Display members 19 are mounted at their lowermost horizontal edges 22 upon supporting roller carriers 23 in accordance with the present invention, which are telescopically extensible so as to enable any of display members 19 to be individually brought forward out of module 10 for individual inspection of goods and the like. The guide channels and roller carriers will be described in greater detail hereibelow.

Referring first to FIG. 2, the roller carrier 23 employed in accordance with the present invention is depicted in an end view which displays the primary elements of its construction. Roller carrier 23 is thus seen to comprise a pair of generally rectangular, longitudinally extended track members possessing generally H-shaped cross sections. Specifically, lower first track member 24 and upper second track member 25 are substantially identical in cross sectional configuration. Both track members possesses a larger track section and a smaller support section adjacent thereto. Track member 24 possesses a support section 26 which communicates with a stationary base to anchor carrier 23 for operation. In the instance where carrier 23 is employed as part of module 10, support section 26 would be anchored to horizontal cross members 14 and 15, for example, by the provision of fasteners placed through base plates 27 forming a part of support section 26. Obviously, the provision of fasteners through base plates 27 is but one of many approaches that may be taken to anchor track member 24 firmly to a base, and thus the scope of the invention should not be limited thereto.

Track member 24 further includes a track section 28 which comprises the bulk of the area defined within track member 24. Track section 28 is provided with an opening 29 for the intrusion therein of a connecting track, discussed below.

Referring further to FIG. 2, second track member 25 is seen to be identical to track member 24 in the provision of a support section 30 provided with flanges 31 corresponding in dimension to base plates 27. Flanges 31 are provided in the instance where a structure having a wide base, such as a box, is mounted upon support section 30. In the illustration of FIG. 1, display members 19 would be supported within the space existing between flanges 31 in support section 30, and would be fastened into position by means of screws or the like, not shown, which would be inserted through holes also not shown provided in walls 32 of support section 30. Thus, the design of support section 30 is seen to allow a flexibility in the employment of the carrier of the present invention not available in carriers known in the prior art.

Second track member 25 likewise defines a track section 33 of identical dimension to track section 28 defined by track member 24. Similarly, track section 33 comprises a large cavity of rectangular cross section provided at the side thereof adjacent track section 28, with opening 34 for the similar purpose of the passage therethrough of connecting track 35. Connecting track 35 is seen to comprise a structure of generally I-shaped cross section which is located as stated before between and within track members 24 and 25. Connecting track 35 possesses a series of paired rollers attached to its vertically directed web member 36. In the illustration of FIG. 2, these roller pairs comprising upper pair 37, central pair 38 and lower pair 39, are positioned on web 36 so as to communicate with corresponding inner track surfaces in both track members 24 and 25. Roller pair 37 thus communicates with inner track surface 40, while roller pair 38 makes contact with inner track surfaces 41, both of said surfaces located within track section 33. Lower roller pair 39 contacts inner track surfaces 42 within track section 28 of first track member 24.

In addition to comprising the paired rollers discussed above, the roller motive means of the present invention further includes a plurality of single rollers 43 in attachment provided to the lowermost area within track section 28 of first track member 24. Single rollers 43 provide part of the loadbearing capability of roller carrier 23, as they are located in direct supportive contact with laterally directed base 44 integral with the lowermost edge of web 36 of connecting track 35. In turn, track member 25 and the load placed thereon are supported upon connecting track 35 by upper roller pair 37, described above. Roller pairs 38 and 39 are thus provided for the function of steadying the movement of track 25 with respect to track 24 while the former is placed under stress, so that extension of track member 25 will occur in a straight line without either the dipping or buckling which characterizes the carriers of the prior art. In this connection, it should be visualized that the roller motive means comprising roller pairs 37, 38 and 39, as well as single rollers 43 may be provided as a cluster within respective track sections 28 and 33 so as to reside in a stacked relationship within a single plane transverse to the longitudinal dimension of roller carrier 23. Further, a plurality of these clusters may preferably be provided along the length of roller carrier 23 in equidistant relationship to each other, whereby the stress of movement under load is distributed equally through each cluster, and the carrier is capable of operating in true cantilevered fashion. Though the displacement of the clusters of rollers has been specifically described in the above manner, a wide variety of locations may be employed within the scope of the invention, whereby either a greater or a fewer number of such clusters may be provided, or roller pairs may alternately be staggered with respect to each other thereby lying in separate transverse planes. As the roller carrier of the present invention is susceptible to modifications of displacement and number of rollers, the invention should not be limited to a particular configuration or displacement thereof.

Referring now to FIGS. 2 and 4, the carrier of the present invention is further provided with a plurality of plate-like restrictor members 45, partially shown, which serve to define the range of extension of carrier 23 by limiting the extent of movement of track member 25 and connecting track 35 with respect to track member 24 and each other. These plate-like restrictors 45 are thus provided on track members 24 and 25 as well as connecting track 35 so as to extend in a direction transsverse to the longitudinal dimension of roller carrier 23, whereby movement of track member 25 in relation to connecting track 35 is prevented beyond a predetermined point by the abutment of appropriately placed restrictor plates. Likewise, similarly placed plates located on track member 24 and the lower portion of connecting track 35 communicate to prevent further relative movement therebetween. Referring specifically to FIG. 4, roller carrier 23 is illustrated in a fully extended position, in which position the carrier is extended to approximately twice its length in the closed position. It can be seen that track member 25 is fully extended with respect to track member 24, yet is supported along approximately 50 percent of its length by connecting track 35. Connecting track 35 is, in turn, supported along 50 percent of its length by track member 24, as indicated earlier, the roller carrier of the present invention is capable of employment in both a horizontal and a vertical plane, wherein extension can be provided in either direction. Accordingly, the foregoing illustrations dealing particularly with vertically extended display carriers should not be construed as limitative, as the carrier may be employed in a wide variety of applications.

The particular application illustrated herein relates to the employment of roller carrier 23 in a retail display module such as module 10 shown in FIG. 1. In that connection and referring to FIGS. 1, 3 and 4, roller carrier 23 is shown to have certain additional features suiting it for this particular application. Thus, as can be seen in FIGS. 1 and 4, roller carrier 23 is provided with a frontal end plate 46 located at the end of track member 25. End plate 46 serves to retain display members 19 and further, by its design, provides a cosmetically pleasing facing for roller carrier 23. Further, referring to FIG. 4, end plates 47 and 48 located at the opposite ends of track member 24 provide additional locations for fastening to the framework of module 10, and are thus included herein. The foregoing members comprising generally a series of closure members, are also capable of providing restriction upon the movement of the respective track members and the connecting track.

Referring to FIGS. 1 and 3, the carrier of the present invention, when employed in the display module illustrated in FIG. 1 further comprises an upper guide channel 21, discussed briefly earlier, which provides support and direction to the upper edge of display member 19. Guide channel 21 comprises a substantially rectangular, longitudinally extended member possessing parallel guide walls 49 which extend downward into communication with horizontal edge 20 of display member 19 and cradle edge 20 throughout its range of movement. Bearing strips 50 are provided along the entire length of the inner surfaces of walls 49 to facilitate the effortless movement invention, no edge 20 through channel 21. The bearing strip 50 may be preferably prepared from synthetic resinous materials providing the appropriate surface lubricity..

Figure 5:
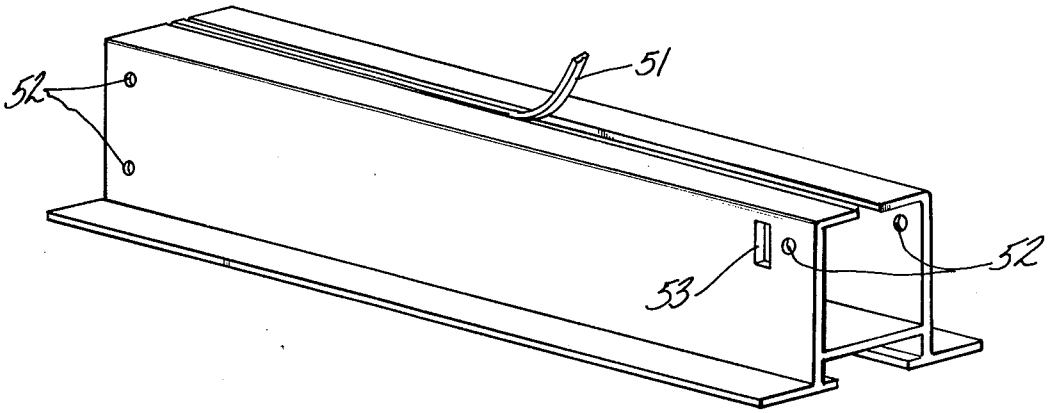
FIG. 5 is a perspective view illustrating the fabrication of the roller carrier of the present invention.

The roller carrier of the present invention may be prepared from a wide variety of materials, and is generally preferably prepared from various metals by extrusion processes, though its to be understood the method of preparation does not form a critical part of the present invention. In the instance where the components of roller carrier 23 are prepared by extrusion, it has been found to be advantageous to prepare track member 24 and 25 as unitary structures possessing continuous outer perimeters. Referring now to FIG. 5, an extrusion employed in accordance with the present invention may be prepared which initially does not of the longitudinally extended opening present in the respective track sections of the track members prepared and employed herein. Instead, the member is extruded as one piece and a tear strip or shear strip 51, comprising an area of reduced thickness, is provided between the opposing edges defining the ultimate openings. This method of construction confers several advantages, among them increased mechanical strength of the extrusion which enables the various drilling operations to be conducted to provide openings, such as those labeled 52 and 53 in the figure, without permitting any undesirable deformation to occur. Further, the provision of the shear strip or tear strip 51 eliminates the need for preparation of the opening by mill sawing or the like, and greater freedom of configuration and design is thus made available.

Referring further to FIG. 5, tear strip 51 is illustrated in the process of being removed, whereby a simple exertion of pulling force through a hand tool such as a pair of pliers or the like is all that is needed.

The carrier of the present invention can, as noted, be prepared from a wide variety of materials. Specifically the extrusions referred to above are preferably made from aluminum base alloys, which confer the advantages of light weight along with strength and resilience during operation, as well as ease of processability during manufacturing. The various rollers employed in the roller motive means may likewise be constructed from a wide variety of materials including certain metals and preferably organic resinous materials such as nylon and the like. As many well-known materials may be employed in the construction of the carrier of the present invention, no need is seen to list them herein, as the invention is not believed limited thereto.

FIG. 6 is provided to illustrate a display member by way of example which may be provided in the instance where the carrier of the present invention is employed in a display module such as that illustrated in FIG. 1. Display member 19 is in the form of a frame provided with a handle 54 at its front and various display means 55. In FIG. 6, 56 comprises a pegboard panel; 57 a shelf; 58 indicates two zigzag connected horizontal wires suitable, for example, for the support of shoes; and 59 indicates a rail or straight horizontal rod. It should be appreciated that any desired display means, other than the example shown, may be provided on member 19 depending on the goods to be displayed. Likewise, though one side of member 19 is shown in FIG. 6, it can be appreciated that member 19 can be provided with identical display means on the opposite side thereof thereby providing, in the instance where the products are of sufficiently reduced size, further display area per unit.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A roller carrier useful in either the horizontal or vertical plane which comprises a generally rectangular, longitudinally extended first track member, said first track member possessing a generally H-shaped cross section defining a support section and a track section; a generally rectangular, longitudinally extended second track member of substantially identical length and cross sectional configuration to said first track member, said second track member disposed adjacent and above said first track member whereby said respective track sections are in face-to-face juxtaposition; a longitudinally extending connecting track located within and between said first and said second track members, said connecting track possessing a generally I-shaped cross section defined by a vertically extending central web member including a laterally extending base member, and roller motive means located within the track sections of said first and said second track members adapted to support said second track member and connecting track, respectively, in spaced relationship above said first track member, said roller motive means comprising a plurality of paired rollers rotatably attached in fixed position on the web member of said connecting track, said paired rollers situated in spaced-apart relationship to each other in both the longitudinal and the transverse plane whereby said rollers are in operative position to contact the respective inner surfaces of the track sections of said first and said second track members, and a plurality of single rollers located and anchored in the lowermost area of the track section of said first track member and in contact with the base member of said connecting track, said roller motive means further adapted to enable said second track member and said connecting track to reciprocate a finite distance in relation to said first track member.

2. The carrier of claim 1 wherein said paired rollers are supported on common axles located in longitudinally spaced-apart, fixed position within said web member and extending laterally therefrom, whereby said paired rollers are disposed in three-tiered relationship with respect to each other in the transverse plane.

3. The carrier of claim 2 wherein said paired rollers and said single rollers are located in roller clusters comprising individual sets of said rollers residing in stacked relationship with respect to each other within a single plane transverse to the longitudinal dimension of said carrier.

4. The carrier of claim 3 wherein a plurality of said roller clusters are provided in equal distance from each other along the entire length of said carrier.

5. The carrier of claim 1 further comprising a plurality of plate-like restrictor members attached to said first track member, said second track member and said connecting track, said restrictor members residing within planes perpendicular to the direction of movement of said connecting track and said second track member, and adapted to communicate with each other to thereby limit the movement of said connecting track and said second track member to finite predetermined distance.

6. The carrier of claim 1 wherein said first and said second track member are provided at the ends thereof with planar closure members serving to restrict the movement of said track members and connecting track with respect to each other.

7. The carrier of claim 1 wherein said carrier is employed in the horizontal plane as a lower support for a vertically extended load.

8. The carrier of claim 1 wherein said carrier is employed in the horizontal plane as an overhead support for a vertically extended load.

9. The carrier of claim 7 wherein said load comprises a vertically extended, planar display member, and said carrier further comprises a longitudinally extending, downward projecting guide channel adapted to retain the upper horizontal edge of said display member.

10. The carrier of claim 9 wherein said guide channel is provided with paired, opposing, longitudinally extended bearing surfaces adapted to reduce the frictional contact between said horizontal edge and said channel.

11. The carrier of claim 10 wherein said first track member, said second track member, said connecting track and said guide channel are all prepared from a metallic material.

12. The carrier of claim 11 wherein said metallic material comprises aluminum which has been shaped to final form by extrusion.

13. The carrier of claim 12 wherein the extrusions comprising said first and said second track member are provided in the as-extruded condition with a removable shear strip, said shear strip comprising a longitudinally extended outer wall portion of reduced thickness.

* * * * *